US007249386B2

(12) United States Patent
Terzo

(10) Patent No.: US 7,249,386 B2
(45) Date of Patent: Jul. 31, 2007

(54) PORTABLE POOL LIFT FOR DISABLED PERSONS

(76) Inventor: Michael B. Terzo, 715 Polk St., Missoula, MT (US) 59802

( * ) Notice: Subject to any disclaimer, the term of this patent is extended or adjusted under 35 U.S.C. 154(b) by 116 days.

(21) Appl. No.: 10/970,441

(22) Filed: Oct. 21, 2004

(65) Prior Publication Data

US 2005/0086730 A1 Apr. 28, 2005

Related U.S. Application Data

(60) Provisional application No. 60/514,233, filed on Oct. 24, 2003.

(51) Int. Cl.
*E04H 4/00* (2006.01)

(52) U.S. Cl. ..... 4/496

(58) Field of Classification Search ..... 4/494, 4/496; 5/86.1, 87.1
See application file for complete search history.

(56) References Cited

U.S. PATENT DOCUMENTS 4,554,691 A * 11/1985 Daugherty ..... 5/87.1
4,941,216 A * 7/1990 Boublil ..... 4/496
5,790,995 A * 8/1998 Caden et al. ..... 5/86.1
6,289,534 B1 * 9/2001 Hakamiun et al. ..... 5/89.1

* cited by examiner

*Primary Examiner*—Charles E. Phillips
(74) *Attorney, Agent, or Firm*—Keith S. Bergman; William A. Jeckle

(57) ABSTRACT

A pool lift has a base, releasably positionable on a pool deck spacedly adjacent a pool edge. The base pivotally mounts an elongate arcuate lift frame about an axis parallel to the pool edge. A hydraulic cylinder extends in pivotal interconnection between the base and the medial portion of the arcuate lift frame to pivotally move a chair user support, carried by the lift frame and oriented in a direction parallel to the adjacent pool edge, from a first upright position spacedly above the pool deck to a second downward position spacedly below the pool deck in the pool cavity. An orienting cable maintains the chair user support in horizontal seating orientation during its course of motion. The hydraulic cylinder preferably is powered by a household pressurized water supply.

11 Claims, 7 Drawing Sheets

PORTABLE POOL LIFT FOR DISABLED PERSONS

RELATED APPLICATIONS

This application claims the benefit of U.S. Provisional Patent Application No. 60/514,233 filed Oct. 24, 2003.

BACKGROUND OF THE INVENTION

1. Field of the Invention

My invention relates generally to aiding and hauling handicapped persons and more specifically to a pool lift to move handicapped persons into and out of an in-ground swimming pool.

2. Description of Prior Art

Exercise in water of a pool has long been recognized as a beneficial type of physical therapy for persons having temporary and permanent disabilities. This type of therapy provides buoyancy in a more dense fluidic medium that removes or lessens more of the forces on a human body than it endures when supported on a rigid surface of a terrestrial environment in a gaseous environment. At the same time the fluidic medium provides more resistance to body motion to beget more exercise than the same motion would beget in a gaseous terrestrial environment. Moving a disabled person between a terrestrial environment and the fluidic environment of an in-ground swimming pool creates various problems, however, and responsively various transfer devices and methods have heretofore become known, many of which are particularly related by their structures to the nature of the disability of the person to be moved and the particular structure of the pool and its environs into which and from which the patient is to be moved. The instant invention provides a new and novel chair-type lift that is of a sufficiently generic nature as to be usable by disabled persons with a substantial range of disabilities and differing biologic characteristics for ingress into and egress from substantially any swimming pool type and size of modern use and construction.

A pool lift must move a user both vertically and horizontally to accomplish its purpose of providing for user ingress into and egress from a pool. Many earlier pool lifts provided a vertical pedestal supported in a pool chamber on the pool side or pool bottom to extend spacedly above a surrounding pool deck with a chair user support carried by a vertically movable portion of the pedestal or by a hoist carried on the upper portion of the pedestal or on a laterally extending beam supported by the upper portion of the pedestal. The chair user support then was pivotally moved in a horizontal plane about a vertical axis between loading and unloading positions which commonly was accomplished by some type of pivoting structure between the vertical pedestal and the chair user support or between the vertical pedestal and its support. These vertical pedestal type supports tend to be massive, often are sufficiently complex or such structure as to require the services of an attendant, were normally of a permanently installed irremovable nature and suffered maintenance and durability problems, especially by reason of continuous emersion in pool water. The instant pool lift is distinguishable from this prior type of pool lift by being removably supported on a pool deck spacedly adjacent a pool side for pivotal motion of a chair user support into the pool water so only the chair user support is immersed in the water environment for only a limited period of time at or between placement of a user into the pool water and removal of the user from the pool water.

Responsive to the foregoing problems various pool lifts having pedestal structures of some type that are mounted in or on a pool deck became known. With these deck mounted pool lifts some portion of the vertical support pillar, or the chair user support, still needed to pivot in a horizontal plane about a vertical axis between a loading and unloading position for use. This combination of horizontal, vertical and pivoting motion still requires complex mechanisms for its accomplishments and these deck supported lifts thus retained structural, mechanical, and operational problems of prior pool lifts having vertical pillars installed wholly or partially in the pool water. These prior pool deck supported lifts still generally require the assistance of an attendant for operation, unless their mechanisms are sufficiently complex to make them cost prohibitive, and most of this type of pool lift still are of a permanent non-movable nature.

The instant pool lift is distinguishable from the prior pedestal type pool lifts in providing a lift frame that is pivotally mounted on a base supported on a pool deck spacedly adjacent the pool edge for pivotal motion in a vertical plane about an elongate horizontal axis that is substantially parallel to the adjacent pool edge and only slightly above the pool deck level. The chair user support of the instant lift is of a chair type and is mounted on a bracket on the upper pool facing portion of the lift frame on an axle that extends horizontally and parallel to the axle interconnecting the base with the lower inner end portion of the lift frame. Further, the chair user support does not pivot in a horizontal plane about a vertical axis when it moves between its upper inward deck access position and its lower outward pool access position.

The particular motion and arcuate shape of the lift frame of the instant pool lift allows it to be of a smaller, more simple and more compact nature than prior pool lifts. The instant pool lift may be fastened to the pool deck for use by bolts or similar fasteners extending through the base and into secure engagement with fasteners carried within the pool deck structure or it may be supported on the pool deck by its own weight or by additional auxiliary weights without mechanical fastening to the deck. The pool lift provides wheels carried on its base to aid its locomotion to and from its mounting or use position. This configuration allows the pool lift to be mounted or supported on a pool deck so that it can be easily moved between a storage position remote from the pool and the pool deck when not required for use.

Various prior pool lifts have been powered by hydraulic systems, generally at relatively high pressures as the structure of such prior lifts often would not allow use of larger hydraulic cylinders that operated at lower pressures. The instant lift structure is of a relatively simple compact nature that does allow for the use of larger hydraulic cylinders and is powered by an ordinary pressurized household water system having water pressure of between approximately thirty and ninety pounds per square inch. This type of low-pressure hydraulic powering system allows use of a less expensive cylinder, provides more maintenance free operation than high-pressure systems and does not require its own pressurizing system. The particular structure of the instant pool lift and its powering system yet allow substitution of high pressure hydraulic cylinders, and known motor powered extensive devices such as screws, rach and pinions and the like. The lower pressure household water supply powering system is preferred over various electrically powered systems as it provides no possibility of electrical shorting problems in the often-wet environs of a swimming pool.

The instant pool lift uses a chair user support formed of molded plastic for greater durability and lower maintenance in the wet environment in which it is used. The molded plastic chair user support also provides fastening structures that allow simple releasable mounting and replacement, also allow formation of strong and durable connecting structures that provides the necessary reliability that is required for apparatus to be used by disabled persons. At the same time the chair user support allows use of safety and control devices and user comfort structures known and desired in contemporary supports for disabled persons.

Since the angular orientation of the chair user support relative to the lift frame and the base varies as the support moves between a position above the pool deck to a position therebelow in the pool cavity, the chair user support is pivotally mounted on the lift frame and its pivotal motion mechanically controlled to maintain a horizontal support orientation throughout the course of the support motion to provide necessary safety of use by a disabled person. To maintain the horizontal orientation of the chair, the pool lift provides a chair flexible push-pull orienting cable carried for axial motion within a flexible supporting tube. The chair orienting cable is interconnected at a first end to a radially extending lever irrotatably carried by the axle connecting the lift frame and the base, and interconnected at a second end with a radially extending lever carried by the axle carrying the chair user support at the upper outer end of the lift frame.

The instant invention lies not in any one of the foregoing features individually, but rather in the synergistic combination of all of its structures that necessarily give rise to the functions flowing therefrom as herein specified.

SUMMARY OF INVENTION

My invention generally provides a pool lift, associated with a pool having a deck about at least part of its upper orifice, that moves a user between a position spacedly above the pool deck and a position spacedly below the pool deck and in the pool cavity for ingress and egress to and from water in the pool.

The lift provides a base supportable on or releasably attachable to the pool deck spacedly adjacent the pool deck edge. The base pivotally supports an arcuate lift frame on a lift frame mounting axle extending generally horizontally and parallel to the adjacent pool edge. The lift frame-mounting axle is journaled by two laterally spaced fastening brackets carried by the base and extends through the lower inner end of the lift frame. The lift frame at its second upper outer end portion carries a chair support axle extending parallel to the lift frame-mounting axle. The chair support axle carries a chair support bracket at one end thereof and this support bracket carries a chair user support facing away from the lift frame and in a direction parallel to the chair support axle. An hydraulic cylinder, having its piston rod pivotally carried on a rearward portion of the base distal from the pool edge and its cylinder pivotally carried on the inner medial portion of the lift frame distal from the pool, moves the lift frame between a first upright position spacedly above the pool deck to a second outwardly and downwardly extended position within the pool chamber. The hydraulic cylinder preferably is powered by a low-pressure household water supply system.

A flexible push-pull cable communicates from a first radially extending lever irrotatably carried by the lift frame axle to a second bell crank irrotatably carried by the chair support axle to maintain the chair user support in a horizontal orientation throughout the motion of the lift frame between its first upright position and second outwardly and downwardly extended position. The chair user support provides a first support arm pivotally mounted at one side for vertical motion to aid user ingress and egress, a second support arm rigidly mounted at the opposite side to support various user control mechanisms and a releasably positionable foot rest extending forwardly and downwardly from the chair user support. The base preferably carries at least one pair of parallel laterally spaced wheels in its rearward portion distal from the pool deck edge to aid locomotion to and from a use site.

In providing such mechanism it is:

a principal object to provide a pool lift for disabled persons that has a chair user support movable in a vertical plane by an arcuate hydraulically powered lift frame between a position spacedly above a pool deck and a position spacedly below the pool deck for ingress and egress into and from water of the pool.

A further object is to provide such a pool lift that provides a base supported on the pool deck spacedly adjacent the deck edge that pivotally carries the arcuate lift frame on a lift frame axle orientated parallel to the adjacent pool deck edge with a second support chair axle in its second outer end portion orientated parallel to the lift frame axle that supports the user chair, with an hydraulic cylinder pivotally mounted to the rear portion of the base and its cylinder pivotally mounted in the rear medial portion of a tilt frame to move the tilt frame between upper and lower positions.

A further object is to provide such an hydraulic cylinder that may be powered by a household water supply having pressure of between approximately forty and eighty psi.

A further object is to provide such a pool lift that may be supported on a pool deck by its own weight or auxiliary weights or may be releasably attached to the pool deck and has at least two paired opposed wheels to aid transport of the lift to and from use position on the pool deck.

A further object is to provide such a pool lift that has the support chair mounted at one end of the support chair axle with the chair facing away from the lift frame in a direction parallel to the support chair axle.

A still further object is to provide such a pool lift having a chair orienting flexible push-pull cable axially movable within a flexible tubular cover communicating from a first radially extending lever irrotatably carried by the lift frame axle to a second radially extending lever irrotatably carried by the support chair axle to maintain the support chair in normal horizontal orientation during motion of the lift frame between uppermost and lowermost positions.

A still further object is to provide such a chair support that has a first user support arm pivotally mounted for motion in a vertical plane, a second control support arm rigidly mounted at the opposite side of the chair support to carry control mechanism, safety belt connecting structure and a releasably positionable foot rest.

A still further object is to provide such a chair lift that is of new and novel design, of rugged and durable nature, of simple and economic manufacture and one that is otherwise well suited to the used and purposes for which it is intended.

Other and further objects of my invention will appear from the following specification and accompanying drawings which form a part hereof. In carrying out the objects of my invention, however, it is to be understood that its features are susceptible to change in design and structural arrangement with only one preferred and practical embodiment of the best known mode being illustrated in the accompanying drawings and specified as is required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

Figure 1:
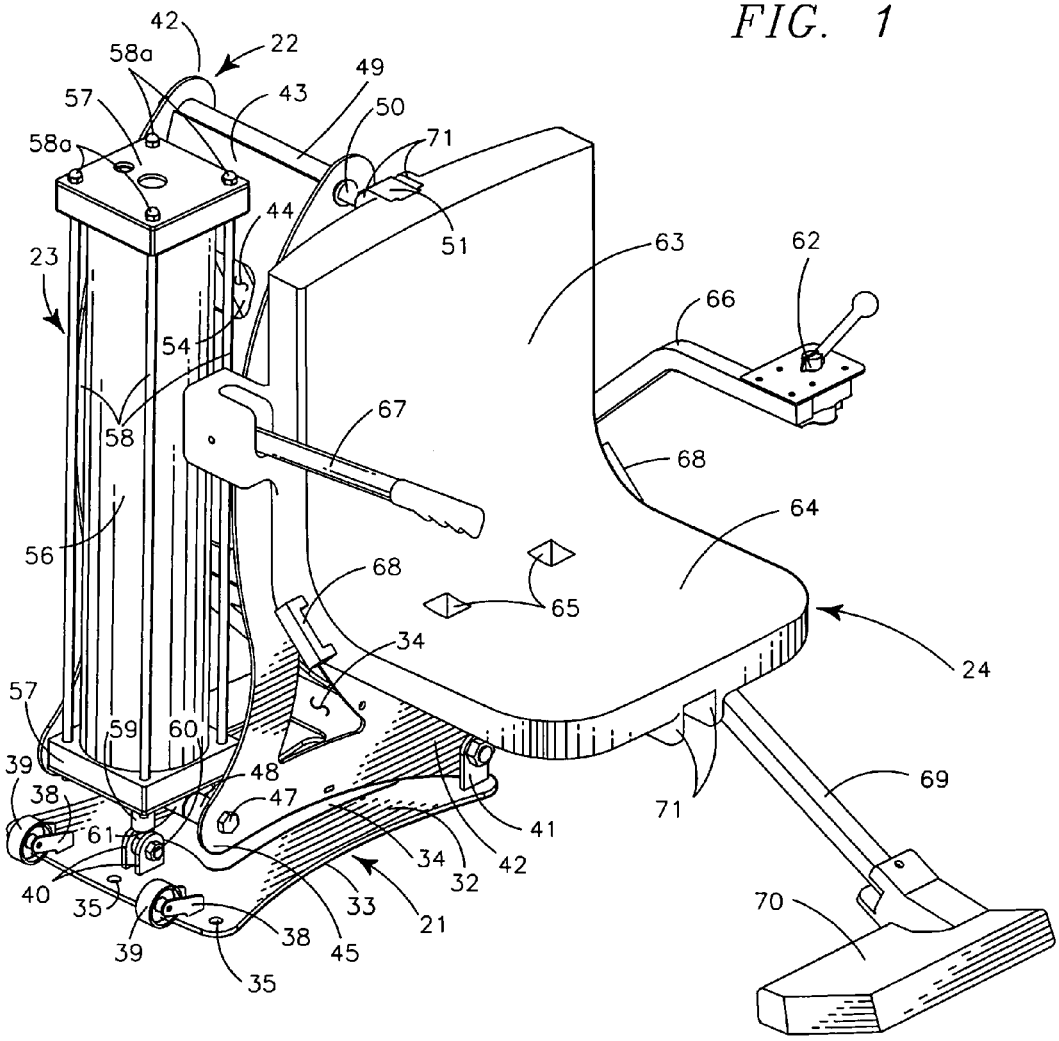
FIG. 1 is a rearward looking isometric view of the front and right side of my pool lift in its upright position showing various of its elements, their configuration and relationship.

My invention generally provides a pool lift having base 21 supported on pool deck 29 of pool structure 20 and pivotally carrying elongate arcuate lift frame 22 having a first lower end portion and an opposing second upper end portion carrying chair user support 24 at the second upper end portion. Hydraulic cylinder 23 pivotally communicates between the base 21 and a medial portion of the lift frame 22 to move the upper end portion of the lift frame 22 between an upright position spacedly above the pool deck 29 to a second lower position at or below the level of the pool deck 29 while the chair user support 24 is maintained in a horizontal use position throughout its course of movement by chair orienting cable 25.

Figure 3:
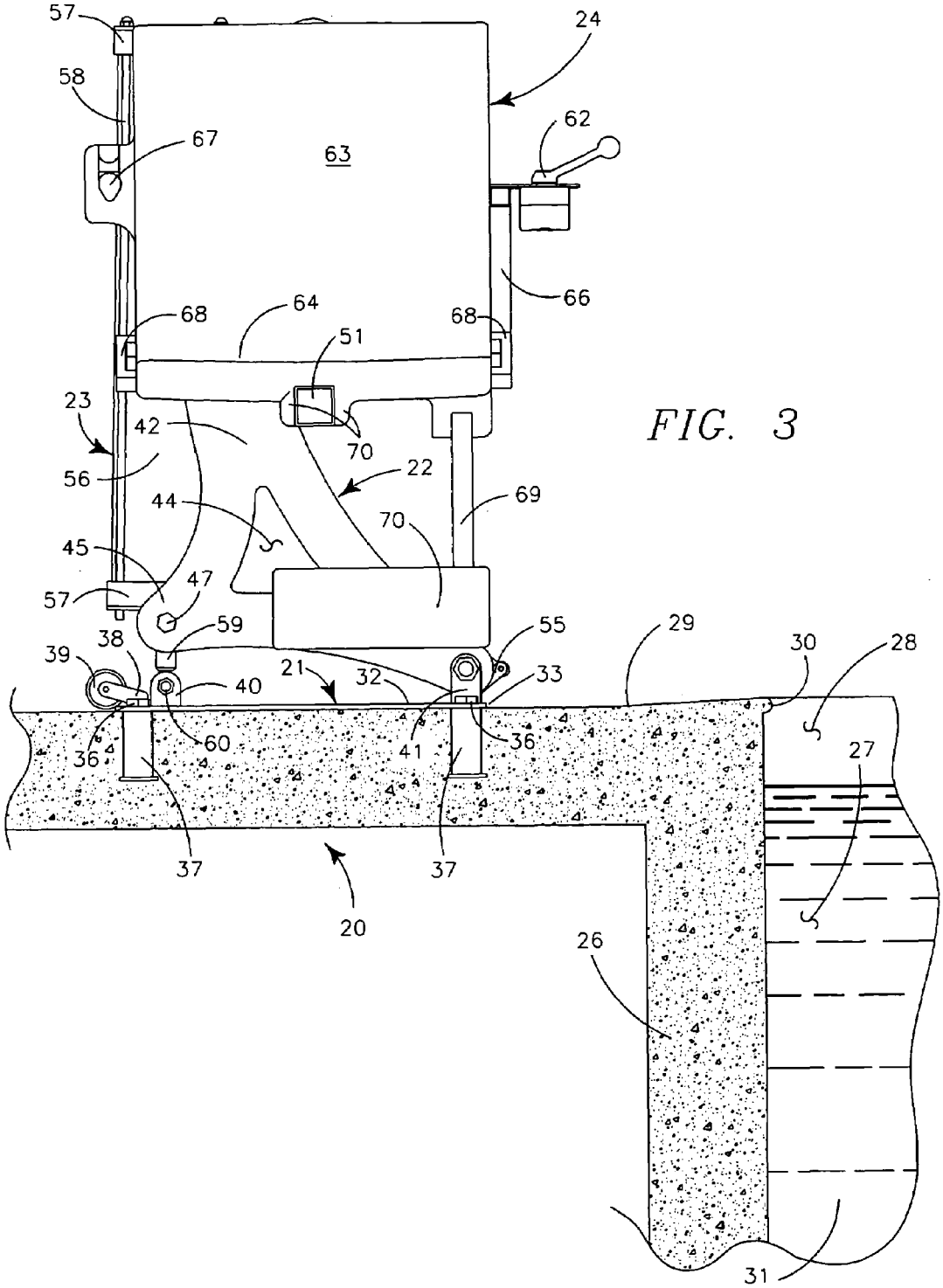
FIG. 3 is an orthographic front elevational view of the pool lift of FIG. 1 on a pool structure shown in partially cutaway cross-section.

As seen in FIG. 3 pool structure 20 with which my pool lift is used, provides a peripheral shell 26 defining a pool chamber 27 for containment of water and an open pool orifice 28 to allow ingress and egress. The pool structure 20 provides a substantially horizontal pool deck 29 surrounding at least a portion of the top pool orifice 28 and defines pool edge 30 at the joinder of the upper surface of pool deck 29 and the upper inner surface of pool peripheral shell 26. The level of water 31 in pool chamber 27 is spacedly below pool edge 30.

Pool lift base 21 is a flat relatively thin rigid plate 32 of elongate configuration defined by curvilinear periphery 33 and preferably having medial portions removed to define medial orifice 34 to lessen weight and conserve materials.

The base plate 32 defines a plurality of spaced fastener holes 35 extending therethrough to receive fasteners 36, in the instance illustrated comprising threaded bolts extending through fastener holes 35 and into fastenable engagement in internally threaded fastener sleeves 37 (FIG. 4) structurally carried in a mating array in pool deck 29 to releasably fasten the base plate 32 on the pool deck 29 spacedly inwardly adjacent pool edge 30 with the longer dimension of the base plate 32 substantially perpendicular to pool edge 30.

The rearward portion of base plate 32 distal from the pool edge 30 carries spacedly adjacent wheel mounting brackets 38 on its upper surface to journal wheels 39 in a position whereat the wheels 39 do not contact the pool deck 29 when base plate 32 rests thereon, but will contact pool deck 29 when the base plate 32 is angled rearwardly toward the wheels 39 to aid in transport of the pool lift.

The laterally medial portion of the base plate 32 rearwardly of medial orifice 34 carries two opposed fastening brackets 40 to pivotally mount piston rod 59 of hydraulic cylinder 23. The forward lateral portions of base plate 32, adjacent first end of the base 32 and the pool edge 30, carry similar opposed fastening brackets 41 to journal a horizontal lift frame axle pivotally carrying first lower end portion of lift frame 22.

Figure 6:
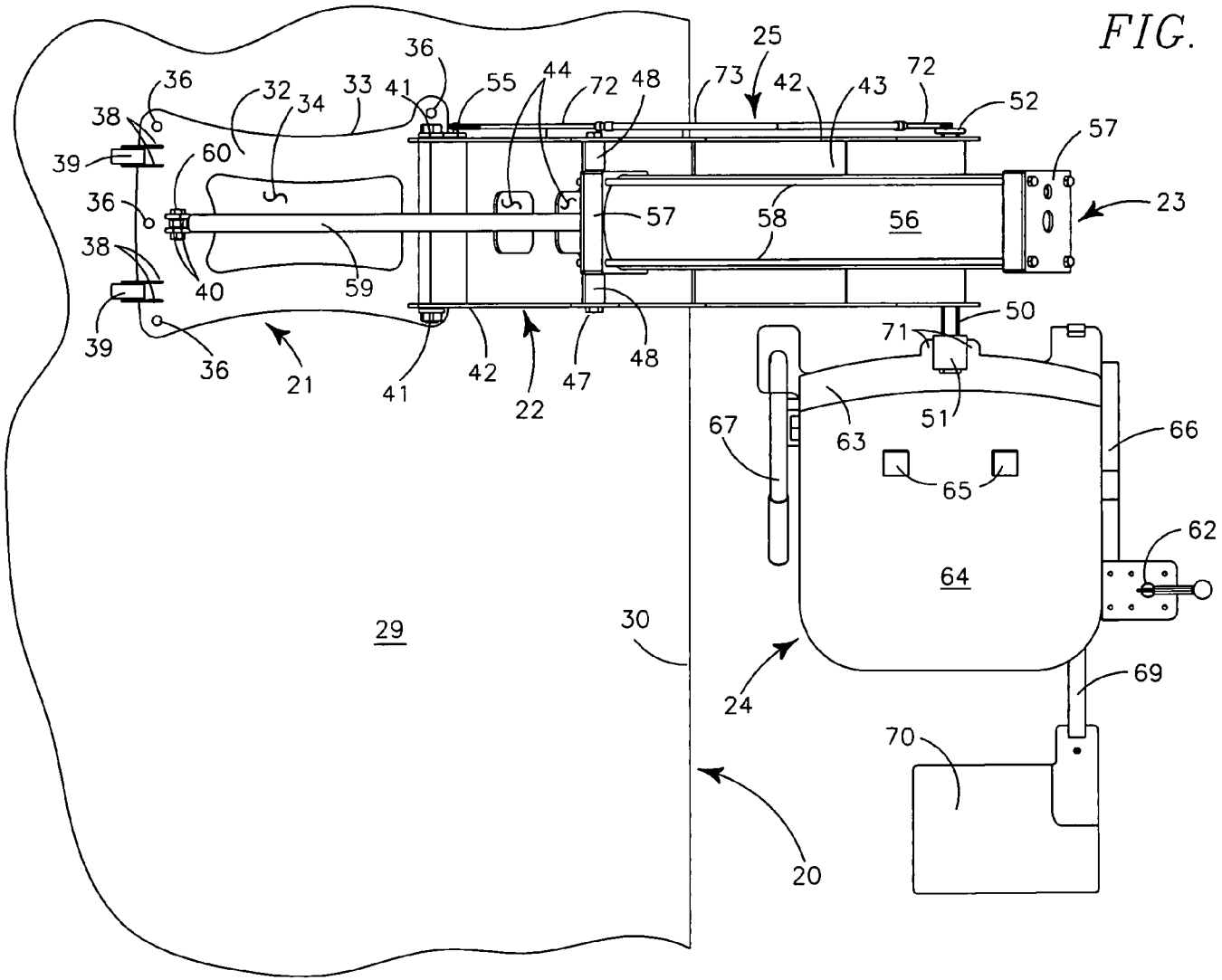
FIG. 6 is a top orthographic view of the pool lift of FIG. 5 in its extended lower position.
Figure 7:
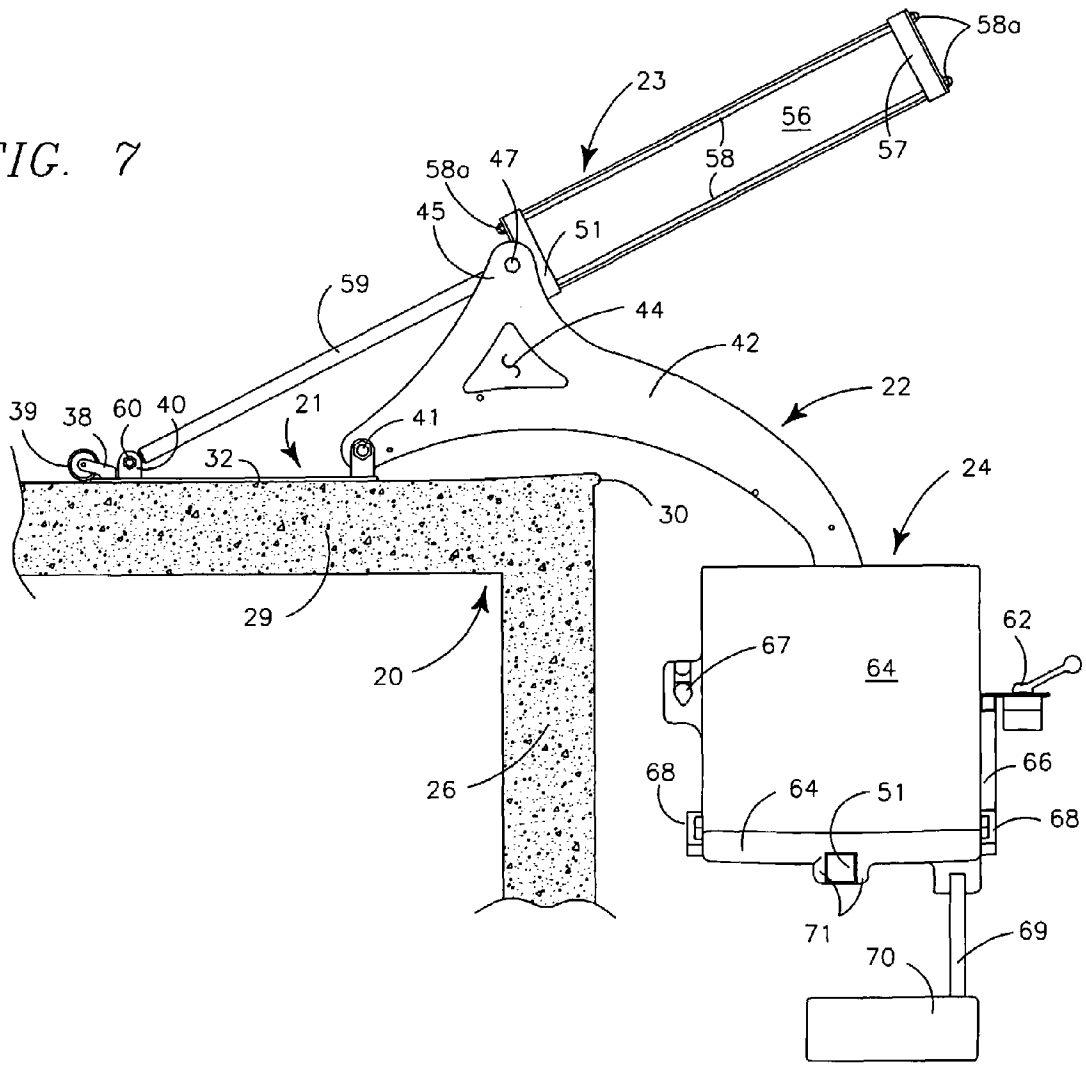
FIG. 7 is an orthographic right side elevational view of the pool lift of FIG. 6 pool structure shown in partial cutaway cross-section.

Lift frame 22, as seen in FIG. 6, comprises an elongate arcuate beam formed by geometrically similar laterally spaced side elements 42 interconnected by back plate 43. The side elements 42 and the back plate 43 have various medial portions removed to form orifices 44 to lessen the mass of the lift frame and conserve material. The side elements 42 define in medial rearward portions similar protuberances 45 to carry a hydraulic cylinder-mounting axle (not shown) extending therebetween. The hydraulic cylinder mounting axle is supported between protuberances 45 by bolts 47 extending through protuberance 45 and into threaded engagement with each end of the hydraulic cylinder mounting axle (not shown) which carries in each lateral portion spacer cylinders 48 to align an hydraulic cylinder fastening sleeve thereon.

The outer end portion of side elements 42 mount spacer tube 49 extending therebetween to carry in its internal channel chair support axle 50 extending spacedly beyond the forward side element 42, as seen particularly in FIGS. 1, 2 and 4, 6.

Figure 4:
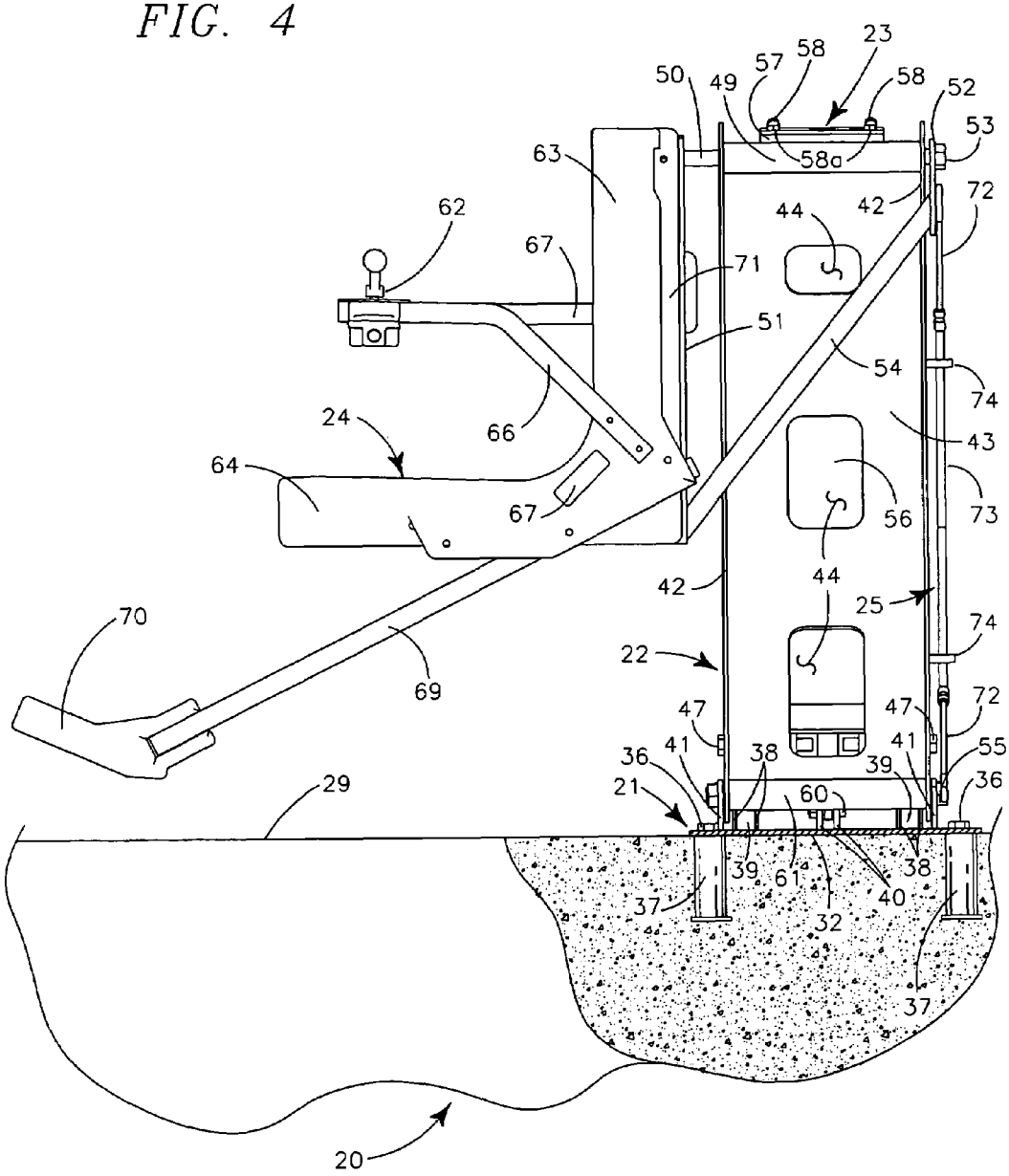
FIG. 4 is an orthographic left side elevational view of the pool lift of FIG. 1 shown in its upright position on a pool deck shown in partial cutaway cross-section.

The forward end portion of chair support axle 50 extending forwardly beyond the forward side element 42 of the lift frame 22 pivotally mounts chair support bracket 51 and the rearward end of the chair support axle 50 projecting rearwardly beyond the rearward side element 42 of the lift frame 22 irrotatably carries support arm bracket 52, as seen in FIGS. 4 and 6, fastened thereto by bolt type fastener 53 extending through the support arm bracket 52 and into threaded engagement with the rearward end of chair support axle 50. The radially outer end portion of support arm bracket 52 interconnects angled support arm 54 which extends angularly forwardly and downwardly to structurally interconnect with the lower end portion of chair support bracket 51. The rearward end portion of the hydraulic cylinder mounting axle (not shown) projects laterally beyond the rearward side element 42 of lift frame 22 to irrotatably carry radially extending lever 55 to interconnect with the lower end portion of chair orienting cable 25.

Double acting hydraulic cylinder 23 provides cylinder body 56 carried in a mounting cage formed by similar spacedly opposed mounting cage ends 57 interconnected by elongate fastening rods 58 extending therethrough and therebetween with threaded ends secured with nut type fasteners 58*a*. The hydraulic cylinder 23 is of a known double acting type powered and controlled by known mechanism. Piston rod 59 of the hydraulic cylinder 23 extends through the lower mounting cage end 57 to depend therefrom for pivotal mounting on a bolt type axle 60 extending through and between piston rod cylinder fastening brackets 40 carried by base 21. The lower end 57 of the mounting cage structurally carries tubular bearing 61 (FIG. 1) to carry in its internal channel the hydraulic cylinder mounting axle (not shown) for pivotal motion relative thereto and is maintained in a medial position between lift frame 22 side elements 42 by spacer cylinders 48. The hydraulic cylinder 23 is provided with a supply of pressurized fluid from an external source (not shown) in the drawings, through control mechanism 62 mounted on chair support arm 66 to regulate the direction and amount of motion of the hydraulic cylinder 23.

Chair user support 24 is an L-shaped element formed by structurally interconnected vertically extending back 63 and horizontally extending seat 64. The chair user support 24 preferably is of a peripheral construction defining a central void to provide some thickness for appropriate strength and rigidity and to create a user psychological benefit gained of more apparent mass. The horizontally extending chair seat 64 provides one or more drain holes 65 extending therethrough. The chair back 63 supports control carrying chair support arm 66 on the left side and a vertically movable armrest 67 on the 66 on the left side and a vertically movable armrest 67 on the right side. The lateral portions of the chair user support 24 at approximately the intersection of chair back 63 and chair seat 64 defines fastening brackets 68 for interconnection of known seat belts (not shown) to assure positional maintenance of a user for safe carriage. Preferably the chair user support 24 provides releasably interconnected angularly depending and forwardly extending footrest support rod 69 supporting footrest 70 for further user safety and comfort.

The rearward side of the vertically extending chair back 63 and lower side of chair seat 64 of the chair user support 24 define two similar spacedly adjacent protuberances 71 defining a channel therebetween to receive chair support bracket 51. The chair support bracket 51 is fastened in the channel between protuberances 71 by fasteners such as bolt/nut combinations or screws extending therebetween. Chair support bracket 51 carries fastening structure at its uppermost end to pivotally mount and positionally maintain the right end portion of chair support axle 50 extending beyond forward side element 42 of lift frame 22.

Figure 5:
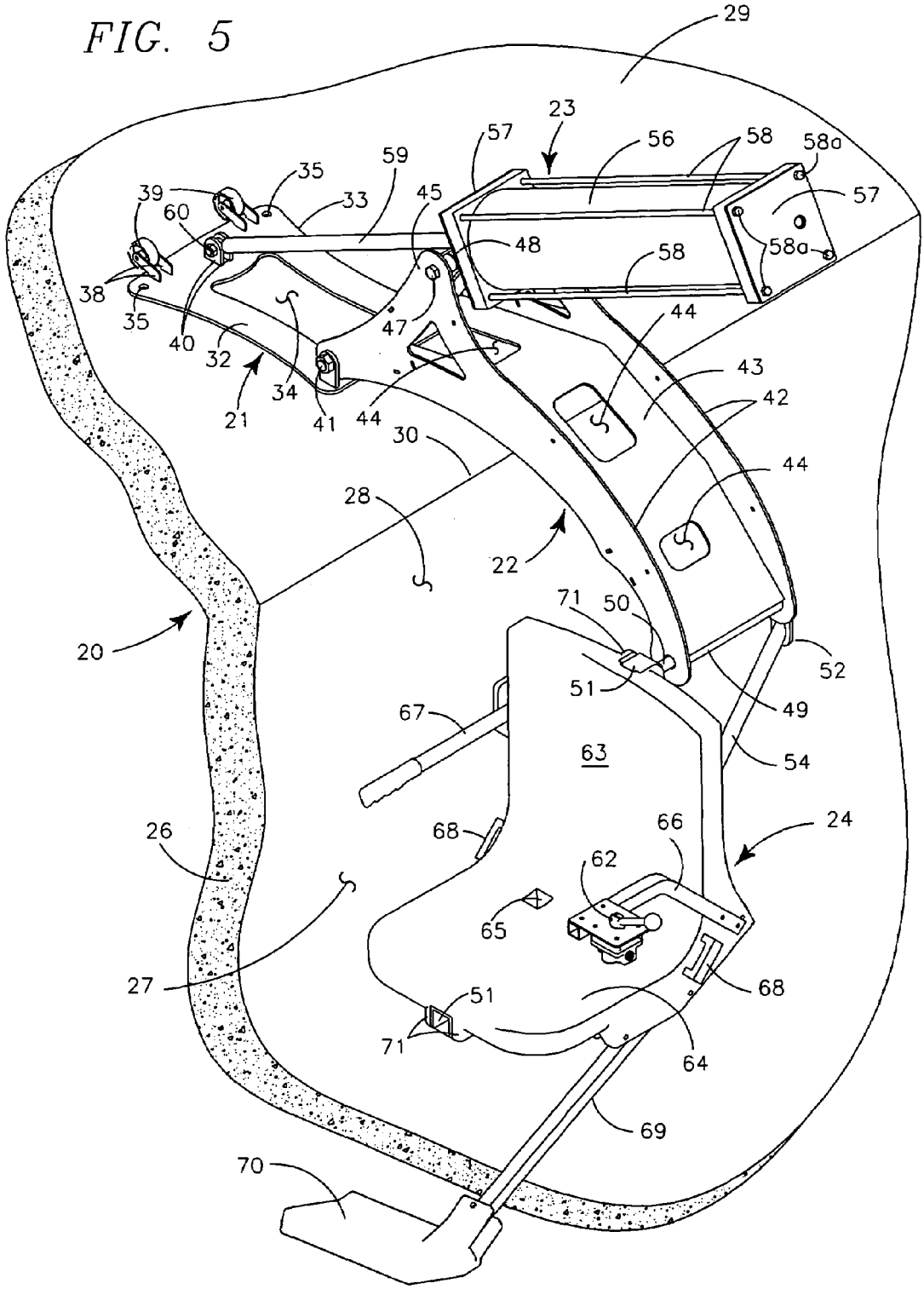
FIG. 5 is a rearward looking isometric view of the front and side of the lift of FIG. 1 in its forward and downward extended position in a pool cavity with the pool structure partially cutaway.

As seen in FIG. 4, chair orienting cable 25 is of a compound nature having inner flexible push-pull cable 72 carried for slidable motion in an axial direction in a flexible tubular outer cable housing 73. The chair orienting cable 25 is interconnected at its lower end with the radially outwardly extending portion of irrotatable radially extending lever 55 and at its upper end with the radially outwardly extending support arm bracket 52. The outer cable housing 73 is supported by plural brackets 74 fastened on the adjacent side of the rearward side element 42 of the lift frame 22. As the lift frame 22 pivots responsive to extension or contraction of piston rod 59 of hydraulic cylinder 23, the rotary motion of the hydraulic cylinder 23 relative to the hydraulic cylinder mounting axle (not shown) carried in tubular bearing 61 is transmitted through inner push-pull flexible cable 72 to support arm bracket 52 to maintain chair user support 24 in a horizontal orientation throughout movement of the lift frame 22 between a first upright position, as illustrated in FIG. 1, and a second downward extended position, as illustrated in FIG. 5.

Having described the structure of my pool lift its operation is described so that it may be understood.

Firstly, the desired position of base 21 on pool deck 29 is determined spacedly distal from pool edge 30 in a position such that lift frame 22 may pivot from its first upright position to its second downward extended position while carrying attached chair user support 24 with no interference from any part of the pool structure. Once this position is determined and if the pool lift is to be fastened to the pool deck 29, the position of spaced fastener holes 35 in base plate 32 is marked on the underlying pool deck 29 and fastener sleeves 37 are established in the pool deck 29 at those predetermined positions. This procedure may be conveniently carried out with the aid of an appropriate jig by amateurs or routiners in the pool or concrete arts. If the pool lift is to be positionally maintained on the pool deck surface by its own weight or by use of additional weights the desired position is merely temporarily marked so that the pool lift may be positioned thereon.

Figure 2:
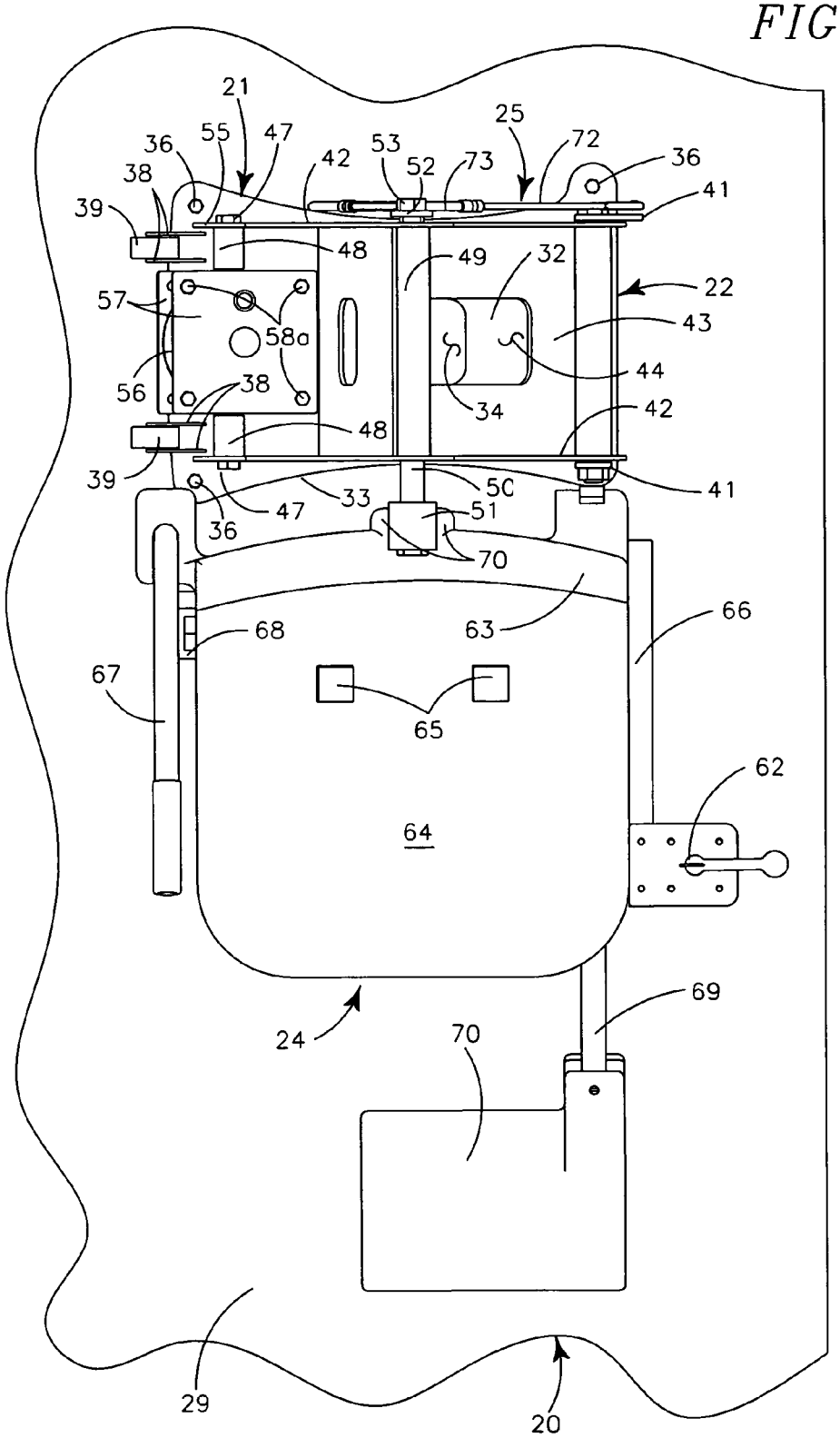
FIG. 2 is an orthographic top view of the pool lift of FIG. 1 supported on a pool deck.

If the pool lift base 21 is to be releasably fastened to the pool deck 29 a pool lift, formed according to the foregoing specification is moved, normally by tilting the structure rearwardly and rolling it on wheels 39, to the desired fastening position, in alignment with the pre-established fastener sleeves 37. Fasteners 36 then are established to pass through fastener holes 35 in base plate 32 and into the associated fastener sleeves 37 for releasable fastening of the base 21 to the pool deck 29. If the pool lift is to be positionally maintained by its own or additional weight the lift merely moved to its proper position. The pool lift then will be positioned, as illustrated in FIGS. 1-3, with chair user support 24 over the pool deck 29 and facing laterally outwardly when in its first upright position.

A user then enters chair user support 24, normally after raising vertically movable armrest 67 upwardly, and is seated on horizontally extending chair seat 64 of the chair user support 24. If vertically movable armrest 67 has been raised it is then lowered to its normal horizontal support position and any available seat belt (not shown) fastened about the user. The user then operates control mechanism 62 to cause pressurized water to flow into hydraulic cylinder 23 to cause piston rod 59 to extend from cylinder body 56 and responsively pivot lift frame 22 forwardly and downwardly to similarly move chair user support 24. When the hydraulic cylinder 23 has reached the desired extension the chair user support 24, while still facing in a direction parallel to the adjacent pool edge 30, will be partially or completely submerged in the pool water 31, depending upon the particular configuration and dimensioning of the lift structure. The user will then be partially supported by the buoyancy of the surrounding pool water 31 and may exit the chair user support 24 by swimming or walking, depending upon the distance of the chair user support 24 from the pool bottom, with or without raising the vertically movable armrest 67. To exit the pool structure 20 the foregoing operation is reversed and the user will be moved to the initial raised position of chair user support 24 spacedly above and over the pool deck 29 and may exit onto the pool deck 29 or some auxiliary transport apparatus as desired.

The foregoing description of my invention is necessarily of a detailed nature so that a specific embodiment of its best mode might be set forth as required, but it is to be understood that various modifications of details, rearrangement and multiplication of parts might be resorted to

I claim:

1. A pool lift to move a person between a pool deck adjacent to a pool structure having a peripheral shell defining a pool cavity, comprising in combination:

a rigid somewhat rectilinear base having a flat substantially planar lower surface with a forward edge positionable substantially parallel to an edge of a pool, a rearward edge positionable distally from the pool edge and first and second ends;

a lift frame, having an arcuate configuration in a vertical plane perpendicular to the adjacent pool peripheral shell with a first lower end, a second upper end and a vertically medial protuberant portion, said lift frame pivotally interconnected with the base at the first lower end by a horizontal lift frame axle supported on the base adjacent the first end, the lift frame having a concave arcuate curvature in a direction toward the pool cavity;

a powering means interconnecting the base at a point spacedly adjacent the second end of the base and the protuberant portion of the lift frame to move the lift frame between an upright position above the pool deck to a downward position with the lift frame second upper end in the pool cavity spacedly below the pool deck;

a chair user support structure carried by a user support axle at the second upper end of the lift frame to extend parallel to the lift frame axle; and a control mechanism carried by the chair user support structure to regulate the powering means to adjustably determine the position of the lift frame and chair user support carried thereby.

2. The pool lift of claim 1 wherein the base carries at least two axially parallel spaced adjacent wheels extending beyond the periphery of the base to aid locomotion of the lifting device to and from a use site.

3. The pool lift of claim 1 wherein the lift frame is formed by two planar similarly shaped spaced arcuate side members structurally connected by an arcuate back plate; and the arcuate shape of the lift frame is such that when the lift frame is pivoted to the downward position the second upper end is below the level of the pool deck and the chair user support is within the pool cavity.

4. The pool lift of claim 1 wherein the powering means comprises a double acting hydraulic cylinder carried in a mounting cage having a first mounting cage end proximal to the piston rod and a second mounting cage end distal from the piston rod; and the hydraulic cylinder piston rod is pivotally interconnected to the base adjacent the second end of the base and the first mounting cage end is pivotally interconnected to the protuberance portion of the lift frame.

5. The pool lift of claim 4 wherein the hydraulic cylinder is powered by a household water supply having water pressure between approximately forty pounds per square inch and eighty pounds per square inch.

6. The pool lift of claim 1 wherein the chair user support structure orienting cable is a flexible push-pull cable axially movable within an outer tubular cable housing communicating from a first radially extending lever irrotatably carried by the lift frame axle to a second radially extending lever irrotatably carried by chair support axle to maintain the chair user support structure in horizontal loading and unloading orientation during lift frame motion between upright and downward positions.

7. The pool lift of claim 1 wherein the chair user support structure is of a chair-like configuration with a peripherally defined structurally joined seat and back formed by molded plastic defining at least one drainage hole extending through the seat.

8. The pool lift of claim 7 wherein the molded chair user support structurally defines two medially positioned spacedly adjacent protuberances on the rearward side of the back and lower side of the bottom to releasably carry a chair support bracket therebetween for releasable fastening on the chair support axle at the upper end of the lift frame.

9. The pool lift of claim 1 wherein the chair user support structure is chair-like with a structurally interconnected back and seat and supports;

a vertically movable armrest extending from a first side of the back forwardly along a lateral edge the seat;

an immovable armrest extending from a second side of the back forwardly along a lateral edge of the seat, and a footrest carried by a footrest support bar extending spacedly forwardly and downwardly from the seat.

10. The pool lift of claim 9 wherein the control mechanism is mounted on one armrest of the chair user support structure.

11. A pool lift to move a person between a pool deck adjacent to a pool structure having a peripheral shell defining a pool cavity, comprising in combination:

a rigid somewhat rectilinear base having a flat substantially planar lower surface with a forward edge positionable substantially parallel to an edge of a pool, a rearward edge positionable distally from the edge of the pool and first and second ends, said base carrying at least two axially parallel spacedly adjacent wheels extending beyond the periphery of the second end of the base to aid to movement of the lifting device to and from a use site;

a lift frame, having an arcuate shape in a vertical plane perpendicular to the adjacent pool peripheral shell with a first lower end, a second upper end, and a vertically medial protuberant portion, said lift frame pivotally interconnected with the base at the first lower end by a substantially horizontal lift frame axle supported on the base adjacent the first end to extend substantially parallel to the first end of the base, said lift frame formed by two laterally spaced similarly arcuately shaped planar side members structurally interconnected by an arcuate back plate, said lift frame having a concave curvature in a direction toward the pool cavity such that when the lift frame is pivoted to a downward position the chair user support structure is within the pool cavity and below the pool deck;

a powering means interconnecting the base at a point spacedly adjacent the second end and the protuberance portion of the lift frame to move the lift frame between an upright position above the pool deck and a downward position with the lift frame second upper end in the pool cavity spacedly below the pool deck, said powering means comprising a double acting hydraulic cylinder operated by pressurized water of a household water supply system and carried in a mounting cage having a first mounting cage end proximal to the piston rod and a second mounting cage end distal from the piston rod with the hydraulic piston rod pivotally interconnected to the base and the first mounting cage end pivotally interconnected to the protuberance portion of the lift frame;

a chair user support structure, carried by a user support axle at the second upper end of the lift frame to extend parallel to the lift frame axle, with a chair user support structure orienting cable communicating between the user support axle and the lift frame axle to maintain the chair user support structure in a horizontal loading and unloading position during motion between upright and downward positions; and a peripherally defined molded plastic chair user support releasably carrying a chair support bracket for releasable irrotatable attachment to the chair support axle, said chair user support having a first pivotally mounted support arm to provide more easy user access to the chair user support, a second rigidly mounted support arm to support control mechanism and a footrest carried by a footrest support extending downwardly and forwardly from the chair user support; and control mechanism carried by the second rigidly attached support arm for regulating pressurized water input to and output from the double acting hydraulic cylinder to responsively regulate motion of the chair user support structure between the upright and downward positions.

* * * * *